United States Patent [19]

Priestle

[11] 4,093,226

[45] June 6, 1978

[54] DINKEY GAME

[75] Inventor: Robert W. Priestle, Highland Heights, Ky.

[73] Assignee: The Raymond Lee Organization, Inc., New York, N.Y.

[21] Appl. No.: 733,809

[22] Filed: Oct. 19, 1976

[51] Int. Cl.[2] ..... A63B 71/02

[52] U.S. Cl. ..... 273/95 F; 273/67 R

[58] Field of Search ..... 273/95 R, 95 F, 104, 273/106 B, 6 TR, 101, 102 S, 129 D, 26 R

[56] References Cited

U.S. PATENT DOCUMENTS

| | | | |
|---|---|---|---|
| 1,128,194 | 2/1915 | Smither | 273/95 F |
| 1,387,946 | 8/1921 | Rutherford et al. | 273/95 F |
| 1,935,370 | 11/1933 | Nekuda | 273/95 F |
| 2,500,683 | 3/1950 | Hosmer | 273/95 F |
| 2,616,692 | 11/1952 | Bird | 273/26 R |
| 3,091,461 | 5/1963 | Taylor | 273/95 F |
| 3,858,879 | 1/1975 | Candor et al. | 273/26 R |
| 3,912,271 | 10/1975 | Stevenson | 273/95 F |
| 3,957,270 | 5/1976 | Fekete | 273/95 F |

FOREIGN PATENT DOCUMENTS

| | | | |
|---|---|---|---|
| 589,556 | 12/1959 | Canada | 273/95 F |
| 375,413 | 6/1932 | United Kingdom | 273/95 F |

OTHER PUBLICATIONS

*Popular Science;* "How to Make a Batting Tee;" Mar. 1959; p. 183.

*Washington Post;* Sunday Comics Section; "Little Iodine;" Apr. 1967.

*Primary Examiner*—Richard C. Pinkham
*Assistant Examiner*—Vance Y. Hum
*Attorney, Agent, or Firm*—Howard I. Podell

[57] ABSTRACT

A competitive game played with a shaped paddle and a shaped dinkey which is either hit by the paddle or is rotated end-over-end by the paddle so as to land the dinkey in an open cylindrical-shaped pan that serves as a goal. A cradle in the form of a bent continuous length of wire is staked into the ground to serve as a holder for the dinkey prior to use and also serves as a goal marker. The dinkey is a block of rectangular cross-section, tapered on each end as a pyramid. Each of the four sides of the dinkey is marked with a different numeral. The paddle is formed of a rectangular shaped block fitted with a handle, formed with a longitudinal tapered side edge.

1 Claim, 6 Drawing Figures

11
11
12
30
30
14
35
10
10
30
14
10

22
23
20
24
23
25
21
20
22
23
25
6
6

32
30
31
35
18
10
19
19
15
16
18
18

36
39
14
37
38

DINKEY GAME

SUMMARY OF THE INVENTION

My invention is a competitive game played with a shaped paddle and a shaped dinkey which is either hit by the paddle or is rotated end-over-end by the paddle so as to land the dinkey in an open cylindrical-shaped pan that serves as a goal. A cradle in the form of a bent continuous length of wire is staked into the ground to serve as a holder for the dinkey prior to use and also serves as a goal marker. The dinkey is a block of rectangular cross-section, tapered on each end as a pyramid. Each of the four sides of the dinkey is marked with a different numeral. The paddle is formed of a rectangular shaped block fitted with a handle, formed with a longitudinal tapered side edge.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figures 1, 2, 3, 4, 5, 6:
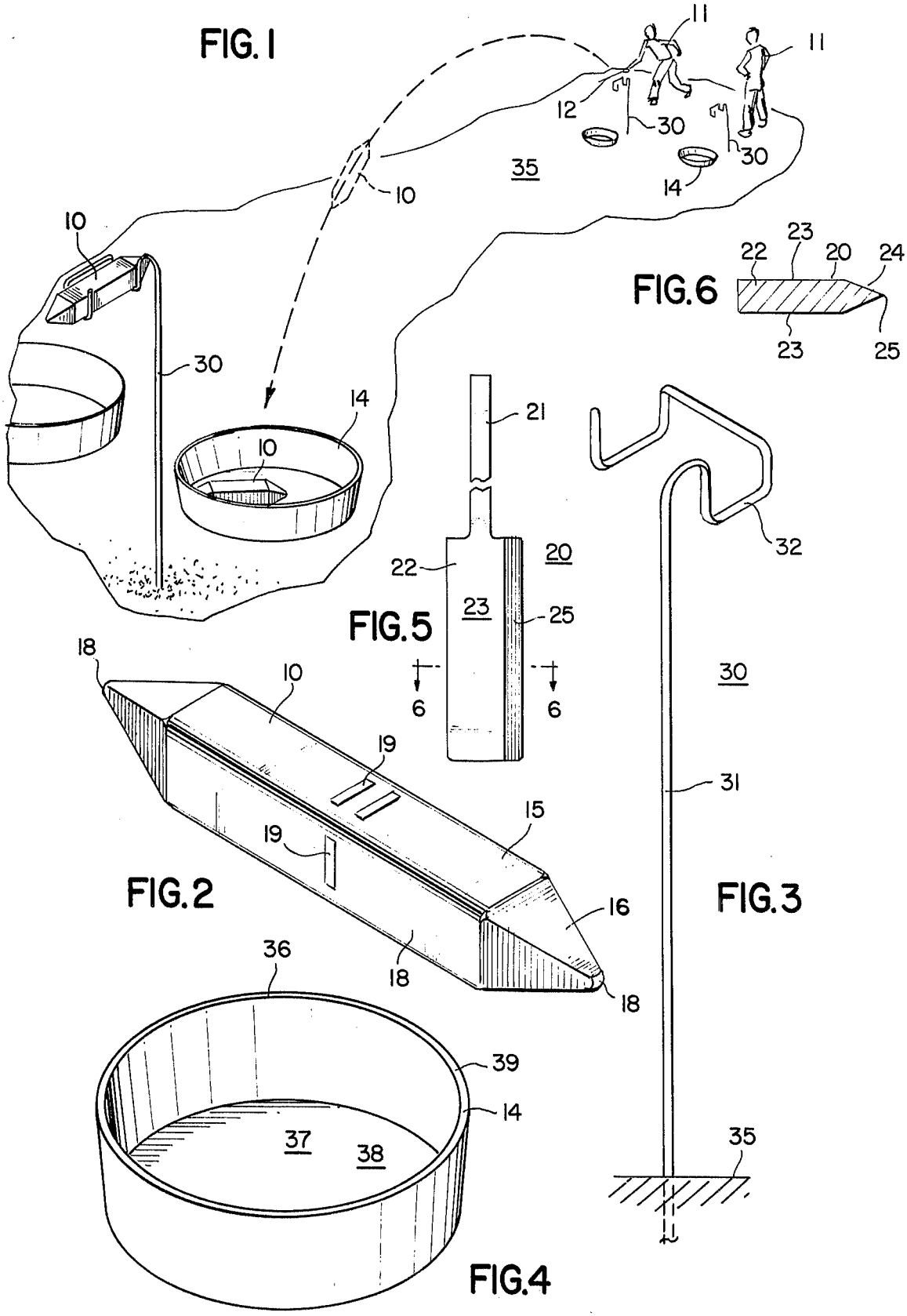
FIG. 1 is a perspective view of the invention in use.
FIG. 2 is a perspective view of the dinkey.
FIG. 3 is a perspective view of the cradle.
FIG. 4 is a perspective view of the goal pan.
FIG. 5 is an elevation view of the paddle.
FIG. 6 is a sectional view of the paddle taken along line 6—6 of FIG. 5.

Turning now descriptively to the drawings, in which similar reference characters denote similar elements throughout the several views, FIG. 1 illustrates two players 11 playing the game of the invention in which the aim of the game is for each player to hit a dinkey 10 with a paddle 12 to drive the dinkey 10 into an open cylindrical pan 14 located at a distance from the players.

The dinkey 10 is a formed of solid block section 18 of square cross-section forming four rectangular-shaped sides 15, with a pair of opposed end sections 16 joined to the block section each shaped as a tapered four sided pyramid section, with the rounded point 18 of each end section 16 extended along the longitudinal axis of the block section and away from the block section 18. Each of the four sides 15 of the block section is marked with a different numeral 19A, 19B.

The paddle 20 is formed of a handle section 21 extending along the longitudinal axis of the paddle 20 and joined at one end to the block section 22 of the paddle. Paddle block section 22 is bounded by a pair of opposed parallel surfaces 23 with a tapered edge section 24 extending along one longitudinal side of block section 22 forming a rounded edge 25.

A cradle 30 is formed of a continuous length of bent wire shaped with a straight shank section 31 that serves as a vertical stake joining a container section 32 bent to detachably retain a dinkey at an elevated point above the ground surface 35 in which shank section 31 is staked. Container section 32 is open to the top, with shank section 31 vertically staked in the ground, and open to each end 30 that the end sections 16 of a dinkey restrain in container section project sidewise beyond the cradle section 32.

Goal pan 14 is formed of a tubular wall 39 joined to a flat circular bottom plate 38, with wall 39 bounding an open chamber 37, of circular cross-section of a diameter greater than the length of the dinkey 10. The diameter of the cross-section of chamber 37 may increase from the bottom plate 38 to the top rim 36 of wall 39.

The game is preferably played by two players 11 by locating a first pair of goal pans 14 on the ground 35 at distance from a second set of pans 14, with each pan 14 of a pair individually colored to indicate the goal of a specific player. A cradle 30 is staked behind each pan 14 with a dinkey 10 mounted in the container section 32 of the cradle. Each dinkey 10 may be individually colored to represent an individual player 11.

The players 11, in turn, attempt to swat a dinkey 10 that is resting in a cradle 30 with the rounded edge 25 of the paddle against the end section 16 of the dinkey 10 so as to cause the dinkey 10 to fly into the distant goal pan 14 marked with their color. The dinkey 10 may be rotated end-over-end if it falls short of the goal pan and rests on the ground, so as to reach the goal pan.

Points are scored based on the numeral 19 that lies face-up on a dinkey 10, after it is hit and penalty points are assessed on the number of turns required to rotate a dinkey 10 from a position short of a goal pan to the goal pan of the player.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, What I claim as new and desire to secure by Letters Patent of the United States is:

1. A competitive game of skill and luck comprising a paddle, an object that is struck by the paddle to cause it to fly towards a goal, and a cradle for retaining the object in an elevated position above the ground prior to being struck, in which the object is a block of square cross-section formed at each of two opposing ends with a pyramid like tapered section, in which the paddle is formed of a handle fitted to a plate bounded by a pair of parallel surfaces that are joined along one side by a tapered section that extends to a rounded edge, and the cradle is formed of a continuous length of bent wire shaped with a straight shank section that serves as a vertical stake, joined at its upper extremity to a container section, said container section formed to fit about the bottom and a pair of opposed sides of the said object and of a length shorter than that of the object, with said container section open at each end and open to the top of the container section, so that the opposed end section of the object may extend beyond the opposed ends of the container section, to permit a player to strike with the paddle, one projecting end of a said object resting in the container section, so as to permit the other end of the object when so struck to freely pivot and to permit the object to freely rise above the container after being so struck by the paddle.

* * * * *